US009480357B2

(12) United States Patent
Price et al.

(10) Patent No.: US 9,480,357 B2
(45) Date of Patent: Nov. 1, 2016

(54) SLIDING BLACKOUT CURTAIN APPARATUS

(71) Applicant: Parenthood Designs, Inc., Davis, CA (US)

(72) Inventors: Teena Price, Davis, CA (US); Christopher T. Cannon, Davis, CA (US)

(73) Assignee: PARENTHOOD DESIGNS, INC., Davis, CA (US)

( * ) Notice: Subject to any disclaimer, the term of this patent is extended or adjusted under 35 U.S.C. 154(b) by 0 days.

(21) Appl. No.: 14/818,828

(22) Filed: Aug. 5, 2015

(65) Prior Publication Data

US 2016/0037953 A1 Feb. 11, 2016

Related U.S. Application Data

(60) Provisional application No. 62/033,818, filed on Aug. 6, 2014.

(51) Int. Cl.

| | |
|---|---|
| ***A47H 15/04*** | (2006.01) |
| ***A47H 15/02*** | (2006.01) |
| ***A47H 1/04*** | (2006.01) |

(52) U.S. Cl.

CPC ..... *A47H 15/02* (2013.01); *A47H 1/04* (2013.01)

(58) Field of Classification Search

CPC ..... A47H 15/02; A47H 15/04; A47H 1/04; A47H 23/00; A47H 2023/003

USPC ..... 160/123–126

See application file for complete search history.

(56) References Cited

U.S. PATENT DOCUMENTS

| | | | | | |
|---|---|---|---|---|---|
| 2,600,152 | A | * | 6/1952 | Blatt | A47K 3/38 160/124 |
| 2,709,831 | A | * | 6/1955 | Mountain | A47H 15/04 16/87.4 R |
| 2,736,373 | A | * | 2/1956 | Truesdale | A47H 5/032 160/124 |
| 3,060,490 | A | | 10/1962 | Saito | |
| 3,422,879 | A | * | 1/1969 | Ryan | A47H 13/16 160/330 |
| 3,497,905 | A | * | 3/1970 | Pflum | A47H 23/06 16/87.2 |
| 3,871,082 | A | * | 3/1975 | Pflum | A47H 1/06 16/87.2 |
| 4,227,564 | A | | 10/1980 | Bratschi | |
| 4,299,008 | A | | 11/1981 | Burns | |

(Continued)

*Primary Examiner* — Katherine Mitchell
*Assistant Examiner* — Abe Massad
(74) *Attorney, Agent, or Firm* — Patentfile, LLC; Bradley C. Fach; Steven R. Kick

(57) ABSTRACT

A sliding blackout curtain apparatus is provided to prevent light leaking from the top and sides of a blackout curtain thereby blocking light from doors, windows, or other light sources. In some embodiments, the apparatus may comprise: a traverse rod preferably installed inside the window casing which includes a track that extends along a portion of the traverse rod, and wherein the track is configured to slidably engage a plurality of curtain flap carriers; a curtain comprising a head with a length; curtain fasteners configured to secure the curtain to a wall or other structure, a curtain flap which is joined to the curtain proximate to the head of the curtain and along the length of the head; and a plurality of curtain flap carriers slidably engaged to the track of the traverse rod.

20 Claims, 4 Drawing Sheets

(56) References Cited

U.S. PATENT DOCUMENTS 4,679,609 A * 7/1987 Bateman ..... A47H 5/032 160/124
4,733,435 A * 3/1988 Darner ..... A47H 15/02 16/87.4 R
4,846,249 A 7/1989 Cooper et al.
5,547,156 A 8/1996 Djuric
8,307,499 B2 * 11/2012 Ruffo ..... A47H 13/00 16/87.2
2004/0123959 A1 * 7/2004 Toti ..... E06B 9/36 160/199
2009/0032205 A1 * 2/2009 Goodner ..... A47H 23/08 160/196.1
2014/0076505 A1 * 3/2014 Mullet ..... E06B 9/72 160/108

* cited by examiner

SLIDING BLACKOUT CURTAIN APPARATUS

CROSS REFERENCE TO RELATED APPLICATIONS

This application claims priority to and the benefit of the filing date of U.S. Provisional Application No. 62/033,818, filed on Aug. 6, 2014, entitled "SLIDING BLACKOUT CURTAIN APPARATUS", which is hereby incorporated by reference in its entirety.

FIELD OF THE INVENTION

The present invention relates to the field of curtains and curtain supporting structures. More specifically, the invention relates to light blocking apparatuses for securing sliding curtains and the like.

BACKGROUND

Multiple devices for the securement of curtains and shades are known in the art. These devices seek to cover windows, doors, and the like to prevent light from entering into a room. Furthermore, a type of opaque curtain known as the "blackout curtain" seeks to block or blackout as much light as possible. Blocking light from entering the room is desirable for a variety of reasons such as improved sleep and other activities that are best accomplished in the absence of light. One type of curtain securing device known in the art comprises a rod to which a curtain is slidably engaged. The rod may pass through apertures in the curtain, or the rod may extend through a generally cylindrical aperture extending the length of the curtain allowing the curtain to slide along the curtain rod to various positions on the rod.

Another type of curtain securing device comprises a curtain rail configured to slidably secure a curtain. Typically, these devices comprise a channel that extends the length of the rail. A plurality of fasteners secures the top of a curtain at one end and slidably secure to the rail at a second end. These fasteners may comprise rolling assemblies that are positioned at the second end which reduce friction as the rolling assemblies move within the channel.

One drawback common to all of these types of devices for the sliding securement of curtains is a universal inability to block light from escaping around their perimeters and into the room. The inability to block light is most prevalent at the top of the curtain as light seeps in around the rod or rail that typically secures the curtain over a door or window. One solution to block light from entering into a room over the top of the curtain is to secure the curtain directly to the wall above the door or window. Unfortunately, this method prevents movement of the curtain away from the door or window making their use extremely difficult.

Another solution that attempts to block light from entering into a room over the top of the curtain is to secure a curtain rod or rail a significant distance above a window or door and then to secure a very long curtain to the rail or rod. This method requires permanent modification to the curtain rod or rail and also is unable to block all of the light from entering a room and often results in a difficult manipulation of the curtain in order to use the door or window it is covering.

Therefore, a need exists for novel curtain apparatuses that block or blackout as much light as possible from entering the room for sleep and other activities that are best accomplished in the absence of light. There also exists a need for novel curtain apparatuses with the ability to block light from escaping around the curtain perimeter and into the room. Finally, there exists a need for novel curtain apparatuses that are able to block light from entering a room without resulting in a difficult manipulation of the curtain or the door or window the curtain is covering.

BRIEF SUMMARY OF THE INVENTION

A sliding blackout curtain apparatus is provided. The apparatus may be secured to structures proximate to a window or door that the apparatus is positioned to cover, and the apparatus may be configured to provide blockage of light from the door, window, or other light source. In some embodiments, the apparatus may comprise: a traverse rod which includes a track that extends along a portion of the traverse rod, and wherein the track is configured to slidably engage a plurality of curtain flap carriers; a curtain comprising a head with a length; a curtain flap which is joined to the curtain proximate to the head of the curtain and along the length of the head; and a plurality of curtain flap carriers with each curtain flap carrier comprising a first end and a second end, and each curtain flap carrier may be slidably engaged to the track of the traverse rod at a first end and configured to couple to the curtain flap at a second end.

In further embodiments, the apparatus may further comprise a faceplate. The faceplate may be coupled to the traverse rod and may extend down and away from the traverse rod a greater distance than the distance the curtain flap carriers extend away from the traverse rod.

In further embodiments, the curtain flap may extend from the curtain head down under the faceplate and up to be secured by the second ends of the plurality of curtain flap carriers.

In still further embodiments, the traverse rod may comprise two or more traverse rod telescoping sections with a first traverse rod telescoping section is telescopically coupled to a second traverse rod telescoping section and with a faceplate coupled to each traverse rod telescoping section.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or"

includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

New curtains and supporting structure apparatuses are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Figure 1:
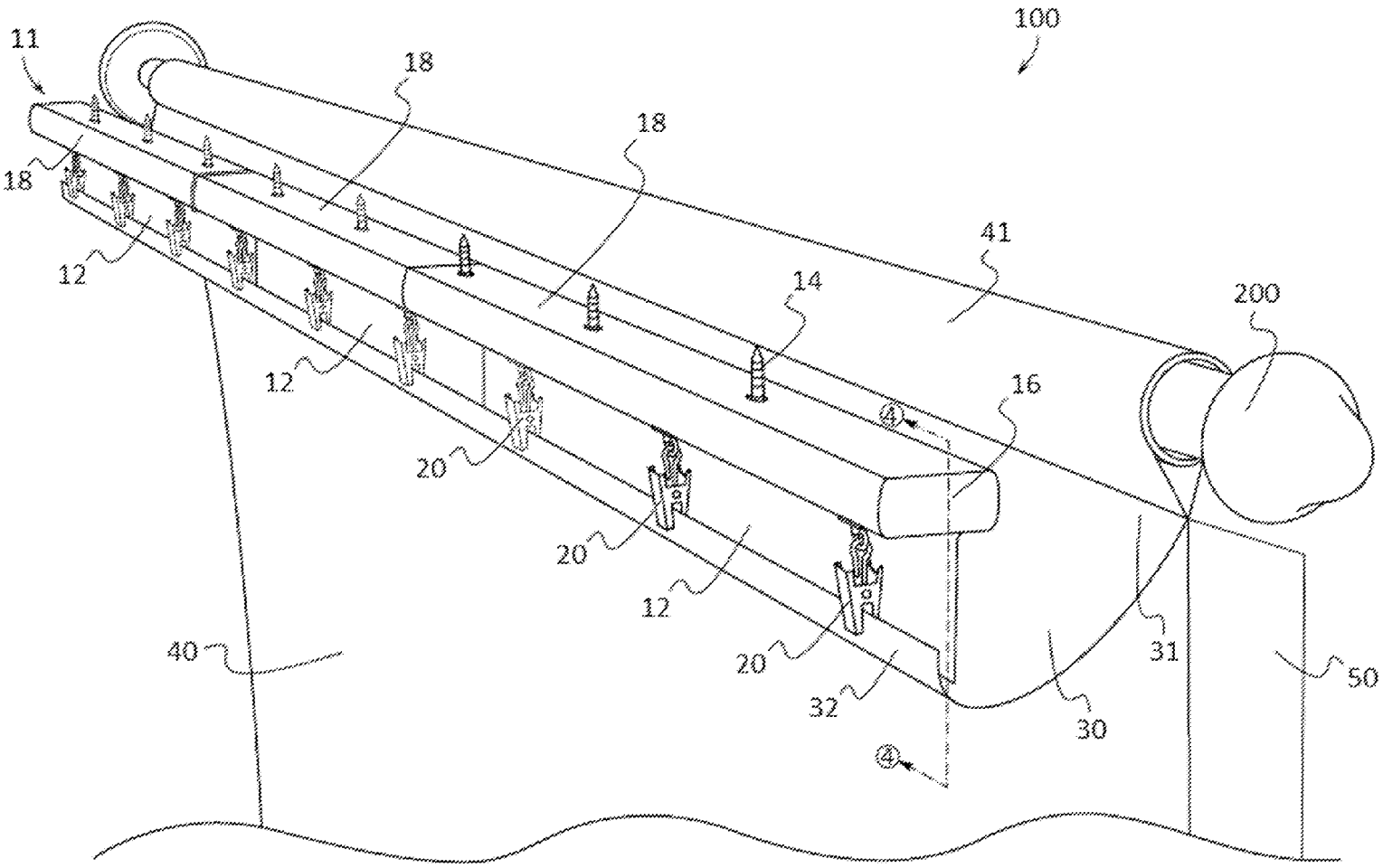
FIG. 1 depicts a top perspective view of the back of an example of a sliding blackout curtain apparatus according to various embodiments described herein.
Figure 2:
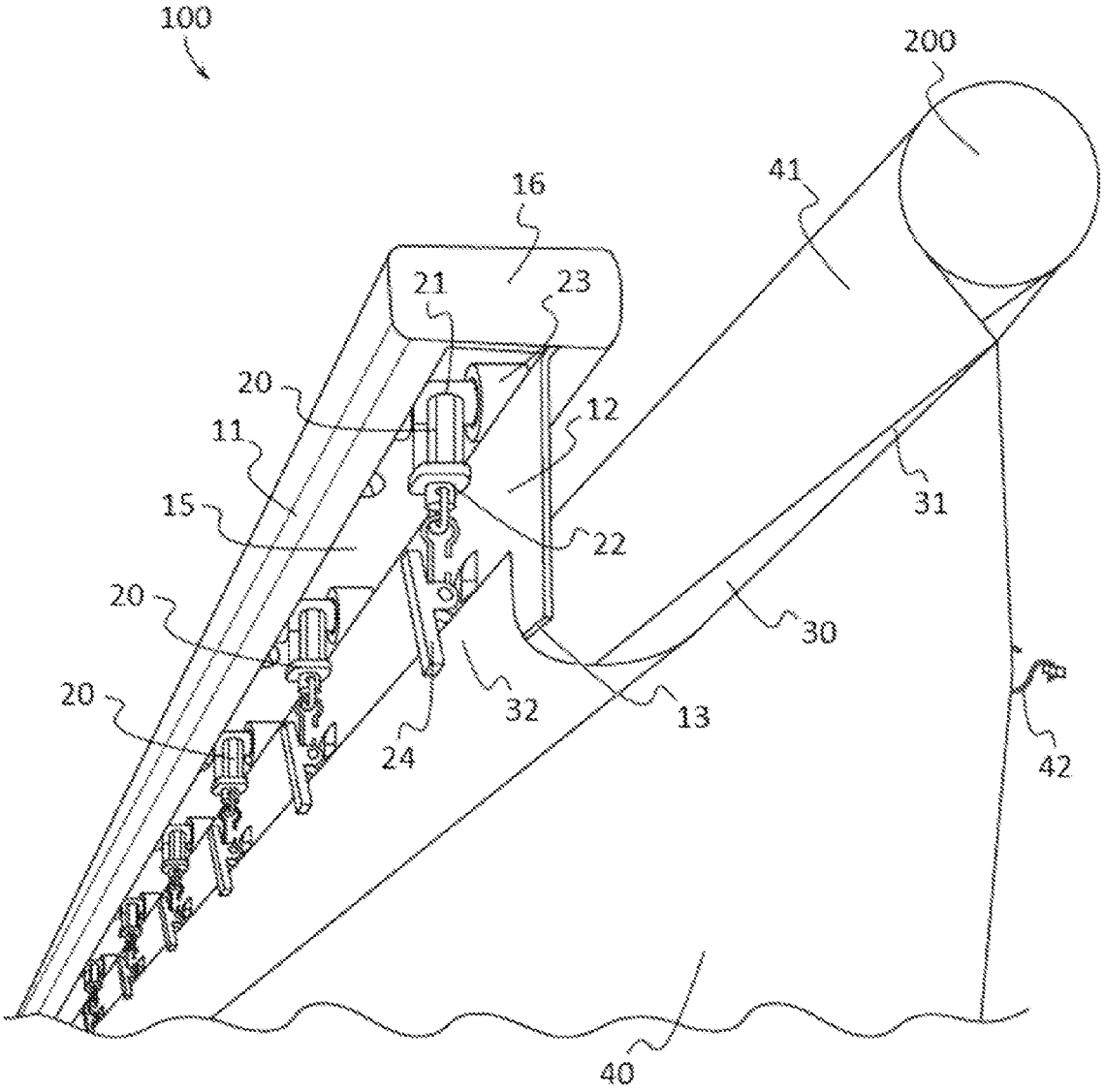
FIG. 2 illustrates a bottom perspective view of the back of an example of a sliding blackout curtain apparatus according to various embodiments described herein.

The present invention will now be described by example and through referencing the appended figures representing preferred and alternative embodiments. FIGS. 1-2 illustrate an example of a sliding blackout curtain apparatus ("the apparatus") 100 according to various embodiments. In this example, the apparatus 100 comprises a traverse rod 11 coupled to a faceplate 12. One or more, such as a plurality, of curtain flap carriers 20 may each be slidably engaged at a first end 21 to a track 15 (FIGS. 2 and 4) in the traverse rod 11 and coupled to a curtain flap 30 at a second end 22. In some embodiments, the apparatus 100 may be configured to be used with a typical curtain rod 200. A curtain 40 comprising a head 41 may be coupled to the curtain rod 200 with the head 41 or top of the curtain 40 slidably secured to the curtain rod 200. The top 31 of the curtain flap 30 may be coupled to the curtain 40, preferably along the width of the curtain 40 and proximate to the head 41 which is slidably secured to the curtain rod 200. The bottom 32 of the curtain flap 30 may extend down under the faceplate 12 and up to be secured to a second end 22 of one or more curtain flap carriers 20. In this manner, when portions of the curtain 40 are moved along the curtain rod 200, such as by being slid open or slid closed by moving portions of the curtain 40 left or right, the top 31 of the curtain flap 30 is coupled to the curtain 40 and configured to move with the curtain 40 as the bottom 32 of the curtain flap 30 moves under the faceplate 12 while secured to the curtain flap carriers 20 which are slidably engaged to the traverse rod 11.

In further embodiments, a curtain 40 may comprise one or more extension flaps 50 that may function to extend the width of the curtain 40 past the width of the curtain 40 that engages the curtain rod 200, the faceplate 12, and/or the curtain flap carriers 20. In further embodiments, the curtain 40 may comprise an extension flap 50 that extends past the width of the curtain 40 that is engaged to the curtain flap carriers 20. An extension flap 50 may be coupled to and positioned on the right side and/or left side of a curtain 40, thereby extending the width of the curtain 40. Preferably, two curtains 40 may be engaged to a curtain rod 200 with each curtain 40 comprising an extension flap 50 so that when the two curtains 40 are drawn together, their extension flaps 50 may overlap.

In further embodiments, the apparatus 100 may comprise a curtain flap 30 which further comprises one or more extension flaps 50 that may extend the width of the curtain flap 30 past the width of the curtain 40 and/or curtain flap 30 that engages the curtain rod 200, the faceplate 12, and/or the curtain flap carriers 20. An extension flap 50 may be coupled to and positioned on the right side and/or left side of a curtain flap 30. Preferably, two curtains 40 may be engaged to a curtain rod 200 with each curtain flap 30 comprising an extension flap 50 so that when the two curtains 40 are drawn together, their extension flaps 50 may overlap.

In some embodiments, an extension flap 50 may be coupled to a curtain flap 30 and/or to a curtain 40 by being press fit or snap fit together, by one or more fasteners such as Velcro type fasteners, tongue and groove fasteners, clip type fasteners, clasp type fasteners, ratchet type fasteners, threaded type fasteners such as screws and bolts, buckle type fasteners and the like, or any other suitable joining method capable of temporarily securing portions of a curtain flap 30, an extension flap, and/or a curtain 40 together. In other embodiments, an extension flap 50 may be substantially permanently joined to a curtain flap 30, and/or a curtain 40 with heat bonding, chemical bonding, stitching, adhesives, clasp type fasteners, clip type fasteners, rivet type fasteners, threaded type fasteners, other types of fasteners, by being integrally woven or formed together, or any other suitable joining method capable of substantially permanently securing portions of an extension flap 50, a curtain flap 30, and/or a curtain 40 together.

In some embodiments, the curtain 40, an extension flap 50, and/or a curtain flap 30 may comprise various types of flexible plastics such as polyvinyl chloride, natural or synthetic rubber, synthetic fabrics such as polyester, acrylic, nylon, rayon, acetate, spandex, lastex, and Kevlar, and natural fabrics such as coir, cotton, hemp, jute, leather, linen, ramie, wool, silk, or any other suitable flexible natural or synthetic material including combinations of materials. In further embodiments, the curtain 40, an extension flap 50, and/or a curtain flap 30 may comprise a triple weave fabric and optionally including black thread woven between the panels of the curtain 40, extension flap 50, and/or a curtain flap 30.

In some embodiments, the apparatus 100 may comprise a curtain fastener 42 (FIG. 2) coupled to the curtain 40. In further embodiments, a curtain fastener 42 may comprise one or more hooks or other fasteners capable of securing portions of the curtain 40 to the wall or other structures adjacent to the window or door that the curtain 40 is positioned to cover. By optionally securing portions of the curtain 40 with one or more curtain fasteners 42 to structures adjacent to the window or door that the curtain 40 is positioned to cover, the curtain 40 may be configured to provide further blockage of light from seeping around the perimeter of the curtain 40, such as around the top, bottom, sides, and/or anywhere else on the curtain 40 proximate to where a curtain fastener 42 is positioned.

In some embodiments, a curtain fastener 42 may comprise Velcro type fasteners, sealable tongue and groove fasteners, clip type fasteners, clasp type fasteners, ratchet type fasteners, threaded type fasteners such as screws and bolts, buckle type fasteners and the like, or any other suitable joining method capable of temporarily securing portions of a curtain 40 to structures adjacent to the window or door that the curtain 40 is positioned to cover. In further embodiments, a curtain 40 may be substantially permanently joined to structures adjacent the curtain 40, or to the window or door that the curtain 40 is positioned to cover by a curtain fastener 42 comprising with heat bonding, chemical bonding, adhesives, clasp type fasteners, clip type fasteners, rivet type fasteners, threaded type fasteners, other types of fasteners, by being integrally molded or formed together, or any other suitable substantially permanently joining method.

In some embodiments, the traverse rod 11 may be secured to a window header or to any other structures or areas adjacent to a window or door that the curtain 40 is positioned to cover with one or more traverse rod fasteners 14. A traverse rod fastener 14 may be positioned on the top, sides or anywhere else on the traverse rod 11 and configured to secure the traverse rod 11 to a window header or any other structure.

In some embodiments, a traverse rod fastener 14 may comprise clip type fasteners, clasp type fasteners, ratchet type fasteners, threaded type fasteners such as screws and bolts, buckle type fasteners and the like, a push-to-lock type connection method, a turn-to-lock type connection method, a slide-to-lock type connection method or any other suitable temporary connection method as one reasonably skilled in the art could envision to serve the function of temporarily securing portions of a traverse rod 11 to structures or areas adjacent to a window or door that the curtain 40 is positioned to cover. In other embodiments, a traverse rod fastener 14 may comprise heat bonding, chemical bonding, adhesives, clasp type fasteners, clip type fasteners, rivet type fasteners, threaded type fasteners, or any other suitable joining method capable of substantially permanently securing portions of a traverse rod 11 to structures or areas adjacent to a window or door that the curtain 40 is positioned to cover.

In some embodiments, the traverse rod 11 may be of a fixed length. In alternative embodiments, the traverse rod 11 may be telescopic in structure and comprise two or more traverse rod telescoping sections 18 configured to extend from or retract into one or more other traverse rod telescoping sections 18. In this manner a first traverse rod telescoping section 18 may be telescopically coupled to a second traverse rod telescoping section 18. Telescopically coupling two or more traverse rod telescoping sections 18 together may allow the traverse rod 11 to secure a curtain flap 30 of a plurality of widths and to be secured to structures or areas adjacent to a window or door that the curtain flap 30 and/or curtain 40 is positioned to cover of a plurality of widths.

Figure 4:
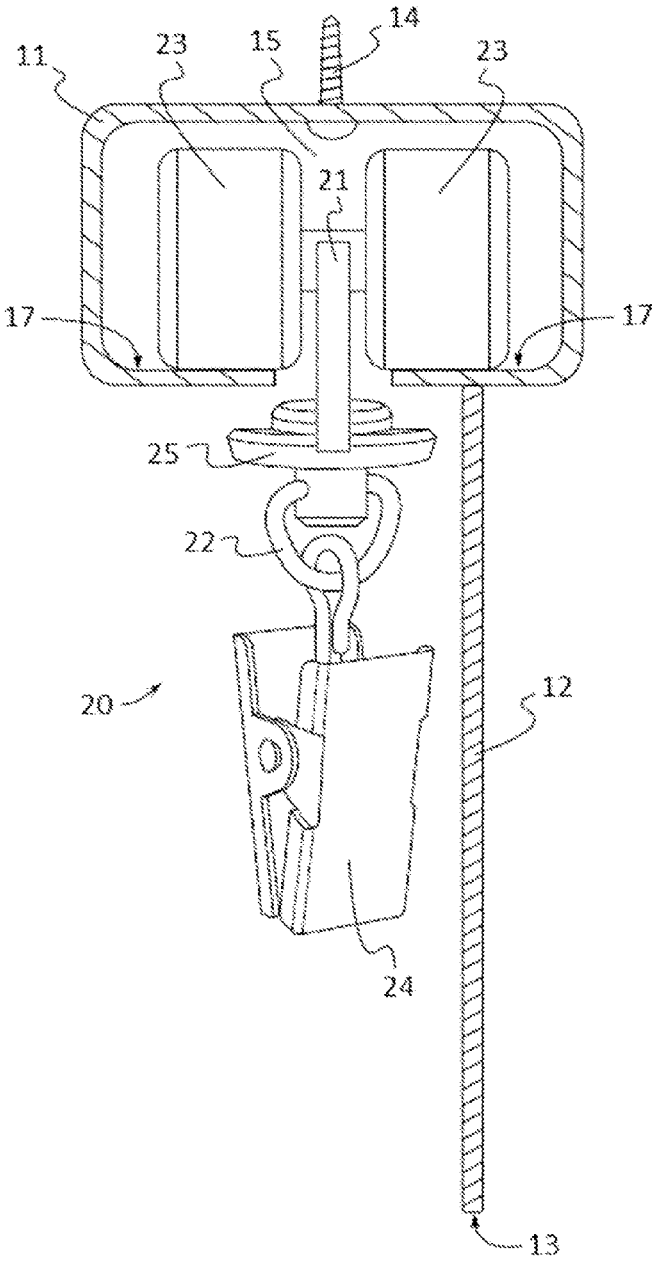
FIG. 4 depicts a sectional, through line 4-4 shown in FIG. 1, elevation view of an example of a traverse rod with a curtain flap carrier slidably engaged within the track of the traverse rod according to various embodiments described herein.

As shown in FIGS. 1, 2, and 4, in some embodiments, the apparatus 100 may comprise a faceplate 12 which comprises a generally planar shape and is perpendicularly coupled to a lower surface of the traverse rod 11. In other embodiments, a faceplate 12 may be joined anywhere along the traverse rod 11 and/or comprise a curved shape, angled shape, or any other shape allowing the faceplate 12 to extend down and away from the traverse rod 11 a greater distance than the distance the curtain flap carriers 20 extend away from the traverse rod 11.

A faceplate 12 may extend down and away from the traverse rod 11 a greater distance than the distance the curtain flap carriers 20 extend away from the traverse rod 11. In some embodiments, the curtain flap 30 may extend from the curtain head 41 down under the faceplate 12 and up to be secured by a plurality of curtain flap carriers 20. In further embodiments, the faceplate 12 may comprise a flap contacting surface 13 configured to contact a portion of the curtain flap 30 to direct the portion of the curtain flap 30 down and away from the traverse rod 11 a greater distance than the distance the curtain flap carriers 20 extend away from the traverse rod 11. In embodiments, in which the traverse rod 11 comprises a fixed length, the apparatus 100 may comprise a faceplate 12 which is coupled to and extends the length of the transverse rod 11. In embodiments, in which the traverse rod 11 comprises two or more traverse rod telescoping sections 18, a faceplate 12 may be coupled to and extend the length of each traverse rod telescoping section 18. In further embodiments, a faceplate 12 may be coupled to and extend the length greater than, less than, or equal to the length of a traverse rod telescoping section 18 and/or the length of the transverse rod 11.

In some embodiments, a faceplate 12 may be temporarily joined to a traverse rod 11 and/or to a traverse rod telescoping section 18 by being press fit or snap fit together, by one or more fasteners such as tongue and groove fasteners, clip type fasteners, clasp type fasteners, ratchet type fasteners, threaded type fasteners such as screws and bolts, buckle type fasteners and the like, or any other suitable joining method capable of temporarily securing portions of a faceplate 12 to a traverse rod 11 and/or to a traverse rod telescoping section 18. In other embodiments, a faceplate 12 may be substantially permanently joined to a traverse rod 11 and/or to a traverse rod telescoping section 18 with heat bonding, chemical bonding, adhesives, clasp type fasteners, clip type fasteners, rivet type fasteners, threaded type fasteners, other types of fasteners, by being integrally molded or formed together, or any other suitable joining method capable of substantially permanently securing portions of a faceplate 12 to a traverse rod 11 and/or to a traverse rod telescoping section 18.

A flap contacting surface 13 may extend along the bottom of a faceplate 12 to provide a preferably low friction surface for the curtain flap 30 to contact and slide against. The flap contacting surface 13 of a faceplate 12 may direct and maintain the position of portions of the curtain flap 30 below the curtain flap carriers 20 allowing the curtain flap carriers 20 to move freely along the length of the traverse rod 11 within a track 15 (FIGS. 2 and 4) of the traverse rod 11.

The traverse rod 11 may comprises a track 15 (FIGS. 2 and 4) or channel that is preferably disposed within the traverse rod 11 and which extends a portion of the length or the entire length of the traverse rod 11. The track 15 may receive the upper or first end 21 of a curtain flap carrier 20, and the track 15 may preferably be complementarily shaped to the first end 21 of a curtain flap carrier 20 allowing the track 15 to slidably secure one or more curtain flap carriers 20. The first end 21 of a curtain flap carrier 20 may be placed in the track 15 by removing, or prior to securing, an end cap 17 to the traverse rod 11. The end cap 17 may provide a stop to the movement of curtain flap carriers 20 within track 15 of the traverse rod 11 to prevent the curtain flap carriers 20 from exiting the track 15. An end cap 17 may be temporarily or permanently joined to a traverse rod 11 by similar methods as used in securing portions of a faceplate 12 to a traverse rod 11.

Figure 3:
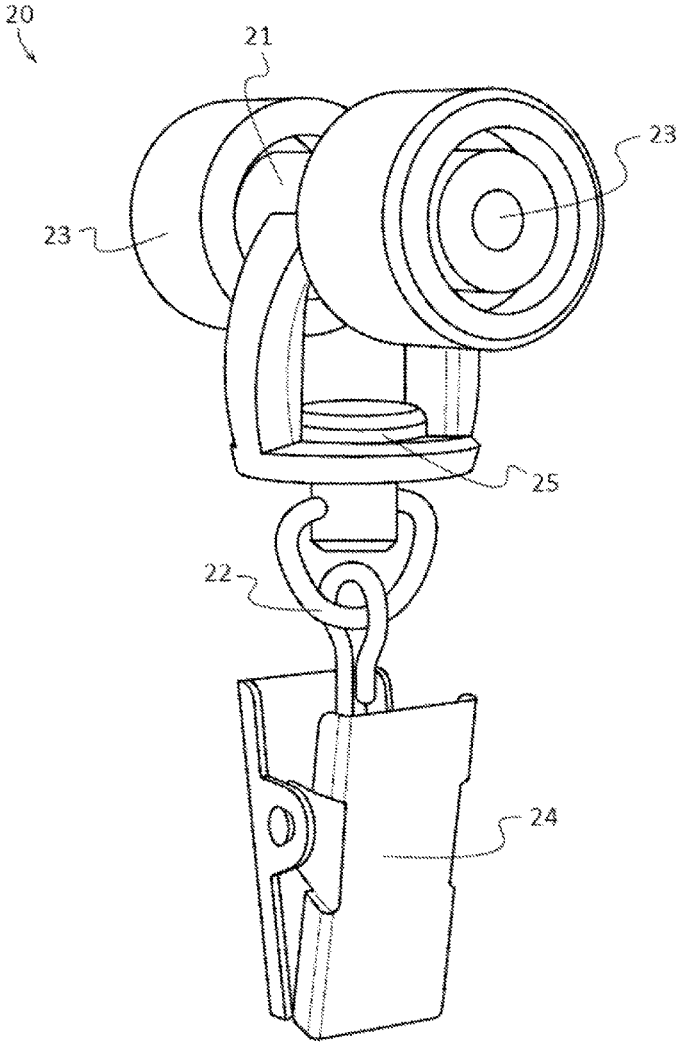
FIG. 3 shows a perspective view of an example of a curtain fastener according to various embodiments described herein.

Turning now to FIG. 3, a perspective view of an example of a curtain flap carrier 20 according to various embodiments described herein is shown. In this example, the curtain flap carrier 20 comprises an upper first end 21 and a lower second end 22. The curtain flap carrier 20 may comprise a conveyance 23 which may be coupled to the first end 21 of the curtain flap carrier 20. In some embodiments, the curtain flap carrier 20 may comprise two or more conveyances 23, such as a first conveyance 23 and a second conveyance 23 coupled to the first end 21 of the curtain flap carrier 20.

In some embodiments, a conveyance 23 may comprise a wheel and the conveyance 23 may be rotatably joined to the first end 21 on an axle, with ball bearings, or with any other suitable joining method allowing the conveyance 23 to rotate while being joined to the first end 21. A conveyance 23 may be configured to fit inside the track 15 (FIGS. 2 and 4) and to produce a low friction contact between a curtain flap carrier 20, the track 15, and/or the traverse rod 11. In other embodiments, the curtain flap carrier 20 may comprise one, three, four, five, six or more conveyances 23 with one or more conveyances 23 configured to fit inside or outside of the track 15 and to produce a low friction contact or engagement between a curtain flap carrier 20, the track 15, and/or the traverse rod 11. In further embodiments, the first end 21 may comprise a non-rotating sliding surface or shape configured to fit within the track 15 and may be a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape. It is not intended herein to mention all the possible alternatives, equivalent forms or ramifications of the invention. It is understood that the terms and proposed shapes used herein are merely descriptive, rather than limiting, and that various changes may be made without departing from the spirit or scope of the invention while providing for a slidable engagement between a first end 21, the track 15, and/or the traverse rod 11.

As shown in FIG. 4, the traverse rod 11, and therefore a traverse rod telescoping section 18, may comprise a track 15 with portions of the track 15 formed by a carrier support surface 17. A carrier support surface 17 may slidably engage a conveyance 23 of a curtain flap carrier 20. In some embodiments, the track 15 may comprise a first carrier support surface 17 and a second carrier support surface 17, and a curtain flap carrier 20 may comprise a first conveyance 23 and a second conveyance 23. The first conveyance 23 of the curtain flap carrier 20 may be slidably or rotatably engaged to the first carrier support surface 17 and the second conveyance 23 of the curtain flap carrier 20 may be slidably or rotatably engaged to the second carrier support surface 17.

The second end 22 of a curtain flap carrier 20 may be configured to couple to a curtain flap 30. In some embodiments, the second end 22 of a curtain flap carrier 20 may comprise a curtain flap fastener 24, such as a spring loaded clip or alligator clip, which may be removably coupled to the curtain flap 30. In other embodiments, a curtain flap fastener 24 may removably couple a curtain flap carrier 20 to the curtain flap 30 by being press fit or snap fit together, by one or more fasteners such as Velcro type fasteners, tongue and groove fasteners, clip type fasteners, clasp type fasteners, ratchet type fasteners, threaded type fasteners such as screws and bolts, buckle type fasteners and the like, or any other suitable joining method capable of temporarily securing portions of a second end 22 of a curtain flap carrier 20 to a the curtain flap 30. In other embodiments, a curtain flap fastener 24 may be configured to permanently couple to the curtain flap 30 with heat bonding, chemical bonding, adhesives, clasp type fasteners, clip type fasteners, rivet type fasteners, threaded type fasteners, other types of fasteners, by being integrally molded or formed together, or any other suitable joining method capable of substantially permanently coupling portions of a curtain flap fastener 24 to a curtain flap 30.

In preferred embodiments, the first end 21 may be joined to the second end 22 with a swivel 25 or other rotatable connection method. In other embodiments, the first end 21 may be joined to the second end 22 with a pivotally joining method such as a butt hinge, butterfly hinge, flush hinge, barrel hinge, concealed hinge, continuous hinge, T-hinge, strap hinge, double-acting hinge, Soss hinge, a flexible material hinge, or any other type or style of hinge. In further embodiments, the first end 21 may be joined to the second end 22 with a static or non-movable connection method such as heat bonding, chemical bonding, by being integrally molded or formed together, or any other static or non-movable connection method.

While some materials have been provided, in other embodiments, some of the elements that comprise the apparatus 100 such as the traverse rod 11, curtain flap carrier 20, and optional faceplate 12 may be made from durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or comprise durable and slightly flexible materials such as soft plastics, silicone, soft rubbers, or any other suitable materials including combinations of materials. In some embodiments, one or more of the elements that comprise the apparatus 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the apparatus 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary connection method as one reasonably skilled in the art could envision to serve the same function. In further embodiments, one or more of the elements that comprise the apparatus 100 may be coupled by being one of connected to and integrally formed with another element of the apparatus 100.

In some embodiments, the traverse rod 11, end cap 17, and/or faceplate 12 may be made from extruded metal alloys or folded sheet metal alloys. One or more elements may be made from or comprise durable and slightly flexible materials such as soft plastics, silicone, soft rubbers, or any other suitable materials including combinations of materials. Additionally, the apparatus 100 may comprise low friction plastics such as Polytetrafluoroethylene (PTFE), low friction ceramics, low friction or lubricated metal alloys, or any other low friction material that is suitable for reducing friction such as on the traverse rod 11, track 15, faceplate 12, and/or on the flap contacting surface 13.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A sliding blackout curtain apparatus, the apparatus comprising:

a traverse rod, wherein the traverse rod comprises a track that extends along a portion of the traverse rod;

a curtain comprising a head, the curtain suspended from a curtain rod, the curtain rod spaced horizontally apart from the traverse rod;

a curtain flap located between the curtain rod and the traverse rod, the curtain flap having a top end and a bottom end, wherein the curtain flap top end is joined to the curtain proximate to the head of the curtain; and a plurality of curtain flap carriers slidably engaged to the track of the traverse rod and the plurality of curtain flap carriers are configured to couple to the bottom end of the curtain flap thereby securing the curtain flap to the traverse rod.

2. The apparatus of claim 1, wherein the curtain further comprises an extension flap.

3. The apparatus of claim 1, further comprising a curtain fastener coupled to the curtain.

4. The apparatus of claim 1, wherein a first end of a curtain flap carrier comprises a conveyance.

5. The apparatus of claim 4, wherein the conveyance comprises a rotatable wheel.

6. The apparatus of claim 4, wherein the track comprises a carrier support surface and the conveyance of the curtain flap carrier is slidably engaged to the carrier support surface.

7. The apparatus of claim 1, wherein a first end of a curtain flap carrier of the plurality of curtain flap carriers comprises a first conveyance and a second conveyance.

8. The apparatus of claim 7, wherein the track comprises a first carrier support surface and a second carrier support surface, and wherein the first conveyance of the curtain flap carrier is slidably engaged to the first carrier support surface and the second conveyance of the curtain flap carrier is slidably engaged to the second carrier support surface.

9. The apparatus of claim 1, wherein a curtain flap carrier of the plurality of curtain flap carriers comprises a curtain flap fastener.

10. The apparatus of claim 9, wherein a curtain flap carrier of the plurality of curtain flap carriers is configured to removably couple to the curtain flap.

11. The apparatus of claim 1, wherein the traverse rod comprises two or more traverse rod telescoping sections.

12. The apparatus of claim 11, wherein a first traverse rod telescoping section is telescopically coupled to a second traverse rod telescoping section.

13. The apparatus of claim 1, wherein a curtain flap carrier of the plurality of curtain flap carriers comprises a swivel.

14. The apparatus of claim 1, further comprising a faceplate, wherein the faceplate is coupled to the traverse rod.

15. The apparatus of claim 14, wherein the curtain flap extends from the curtain head down under the faceplate and is configured to be secured by the plurality of curtain flap carriers.

16. The apparatus of claim 14, wherein the faceplate extends along the traverse rod proximate to the track.

17. The apparatus of claim 15, wherein the traverse rod comprises two or more traverse rod telescoping sections.

18. The apparatus of claim 15, wherein a first end of a curtain flap carrier of the plurality of curtain flap carriers comprises a conveyance, and wherein the track comprises a carrier support surface and the conveyance of the curtain flap carrier of the plurality of curtain flap carriers is slidably engaged to the carrier support surface.

19. A sliding blackout curtain apparatus, the apparatus comprising:

a traverse rod, comprising a track;

a curtain rod spaced horizontally apart from the traverse rod; a curtain suspended from the curtain rod; and a curtain flap extending between the curtain rod and the traverse rod, the curtain flap having a top end and a bottom end, wherein the curtain flap top end is coupled to the curtain and the curtain flap bottom end is coupled to the traverse rod through a curtain flap carrier, wherein the curtain flap carrier is slidably engaged to the track.

20. The apparatus of claim 19, further comprising a faceplate coupled to the traverse rod.

* * * * *